US006117336A

United States Patent [19]

Sachse

[11] Patent Number: 6,117,336

[45] Date of Patent: Sep. 12, 2000

[54] SELF-CLEANING WATER POWERED HELIX BOOM

[76] Inventor: Marvin H. Sachse, 6650 W. 80th St., Los Angeles, Calif. 90045

[21] Appl. No.: 09/253,181

[22] Filed: Feb. 19, 1999

Related U.S. Application Data

[60] Provisional application No. 60/075,441, Feb. 20, 1998.

[51] Int. Cl.[7] ..... C02F 1/00

[52] U.S. Cl. ..... 210/747; 210/776; 210/156; 210/170; 210/242.3

[58] Field of Search ..... 210/747, 776, 210/156, 157, 161, 170, 242.3; 198/583

[56] References Cited

U.S. PATENT DOCUMENTS

| | | |
|---|---|---|
| 3,151,068 | 9/1964 | Long et al. . |
| 3,447,683 | 6/1969 | Luce, Jr. . |
| 3,527,349 | 9/1970 | Lynch . |
| 3,618,768 | 11/1971 | Brown . |
| 3,779,385 | 12/1973 | Strohecker . |
| 4,151,081 | 4/1979 | Bolli et al. . |
| 4,196,087 | 4/1980 | Gordon . |
| 4,440,539 | 4/1984 | Sullivan . |
| 4,929,350 | 5/1990 | Wade et al. . |
| 5,316,029 | 5/1994 | Campbell et al. . |
| 5,609,755 | 3/1997 | Vilandre . |

*Primary Examiner*—David A. Simmons
*Assistant Examiner*—Fred Prince
*Attorney, Agent, or Firm*—Blakely, Sokoloff, Taylor & Zafman LLP

[57] ABSTRACT

The helix boom removes floating objects from a waterway by transporting them to the waterway side for containment and subsequent removal. Lateral transport across the waterway width is accomplished by the rotation of the buoyant boom transversing the waterway. Energy from the moving water causes the rotation of the floating boom. A continuous narrow helically shaped fin is affixed to the cylindrical surface of the boom. The water flow impacting the boom and helix causes the apparatus to rotate. Floating objects are impeded by the cylindrical boom. The rotating helix contains the floatables within the fins, causing the translational movement of the floatables across the boom face to the waterway side where the floatables may be deposited into a collection bin. Multiple booms may be utilized down stream for redundancy. An individual boom may be comprised of small segments connected together on a center hub. Variations in fin size, section size, buoyancy and lead angle accommodate variations in waterway flow rates, floatable composition, water depth and water density.

28 Claims, 6 Drawing Sheets

SELF-CLEANING WATER POWERED HELIX BOOM

CROSS-REFERENCES TO RELATED APPLICATIONS

This application claims the benefit of U.S. Provisional Application Ser. No. 60/075,441, filed Feb. 20, 1998, which is incorporated herein by reference.

BACKGROUND OF THE INVENTION

1. Field of the Invention

The present invention relates to the separation of solids from liquids. In particular, the present invention relates to separating floating solids, such as plastic debris, from the surface of a moving liquid stream, such as water in a waterway, and conveying the floating solids to the side of the liquid stream by a screw type conveyor.

2. Prior Art

Containment booms have been used for the containment and control of petroleum spills. These devices typically keep the petroleum spill from dispersing on the water's surface, containing the spilled material for removal. These booms are typically portable and are deployed around a spill.

Floatable objects are driven along waterways—such as storm culverts, flood control channels, and natural streams—by the forces of stream flow, tidal action and wind forces. Once floatables have moved from the confines of the waterway stream, flow forces are subordinate to tidal and wind forces. Inevitably the vast majority of the floatables are deposited on beaches and shores neighboring the waterway outlet. Floatables deposited on shores and beaches represent a nuisance and a health threat to humans using these resources. Decomposing floatables also damage the marine life. Floatables which are not deposited on shores foul marine equipment, presenting a hazard to navigation.

Boom systems are associated with petroleum spills and containment. Containment booms that remove floatables are typically comprised of large mesh nets strung across the waterway to catch floatables on the net structure. These devices are ineffective, as once the net mesh becomes plugged with floatables, the net's resistance to water flow causes an increase in hydraulic drag force on the net. This increased drag force damages the net or causes the net to be displaced vertically from the path of the stream flow. Moreover, the floatables entrapped in the net are difficult to remove from the net and are frequently released into the waterway during the removal operation.

Log booms are used to collect large floating objects swept down waterways. They are not effective in removing or containing light floatables, which tend to be driven over the top of the log boom. Petroleum booms of various sizes, shapes and construction methodologies used in petroleum containment are also ineffective in containing and entrapping floatables.

Existing boom systems primarily contain pollutants, usually petroleum products for subsequent removal from the containment system. The helix boom is unique in that in addition to containing the floatables, it removes them from the water by transporting them to the waterway side for collection and subsequent removal the collected floatables.

BRIEF SUMMARY OF THE INVENTION

The helix boom is used to remove floating materials that enter oceans and lakes through storm drain systems, streams and tributaries. The materials are long lived and are environmentally persistent in aqueous medium. Their removal is important to the marine environment as it protects marine life from pollution, contamination and loss of oxygen from competing microorganisms using the floatable as a habitat.

The helix boom is comprised of three elements, the central structure, a fin fixed to the central structure to form a helix, and an axle about which the central structure and attached helical fin may freely rotate. The boom is buoyant with approximately one-half of the boom submerged when in operation. The boom is attached to opposite sides of a waterway, in a manner that allows the helix boom to float on the water's surface and rotate, driven by the flow of water past the boom.

In one embodiment, the central structure is comprised of a series of cylinders, which may be connected together, to provide a variable length boom that extends the width of the waterway. The boom is located substantially perpendicular to the flow of water in the waterway. In some embodiments, the boom may be slightly angled to or away from the direction of water flow. Depending upon the waterway width, a center support may also be utilized to stabilize the helical boom.

The fin is attached normal to the surface of the central structure, which is preferably a cylinder, traversing the length of the structure, describing the configuration of a helix or screw along the entire length of the boom. The helix provides two functions. The first function is to present sufficient drag and pitch to cause the boom to be rotated by the energy of the flowing water impinging on the submerged portion of helical shaped fin. The boom's geometry enables the moving water to pass below the surface of the cylinder, with the floatables impacting on the boom's upstream surface. The floatables are contained by the cylinder and fins. The boom's rotation causes the floatables trapped on the boom's surface to be moved laterally across the length of the boom. The floatables, once conveyed across the helix boom, depart the boom to be deposited into a collection device located on the waterway's bank.

The boom may be comprised of any number of pitched helical segments to form a full boom. Any number of booms may be used to traverse the waterway. Booms can be fabricated with right hand or left hand pitch to control the end at which the floatables will be discharged. Booms can be assembled with both right and left hand pitches in a single boom, thereby moving floatables from the middle outward. The rotation is caused by the energy contained in the flowing water with the helix pitch angle determining the rotational force imparted by the water.

DETAILED DESCRIPTION OF THE INVENTION

Figure 1:
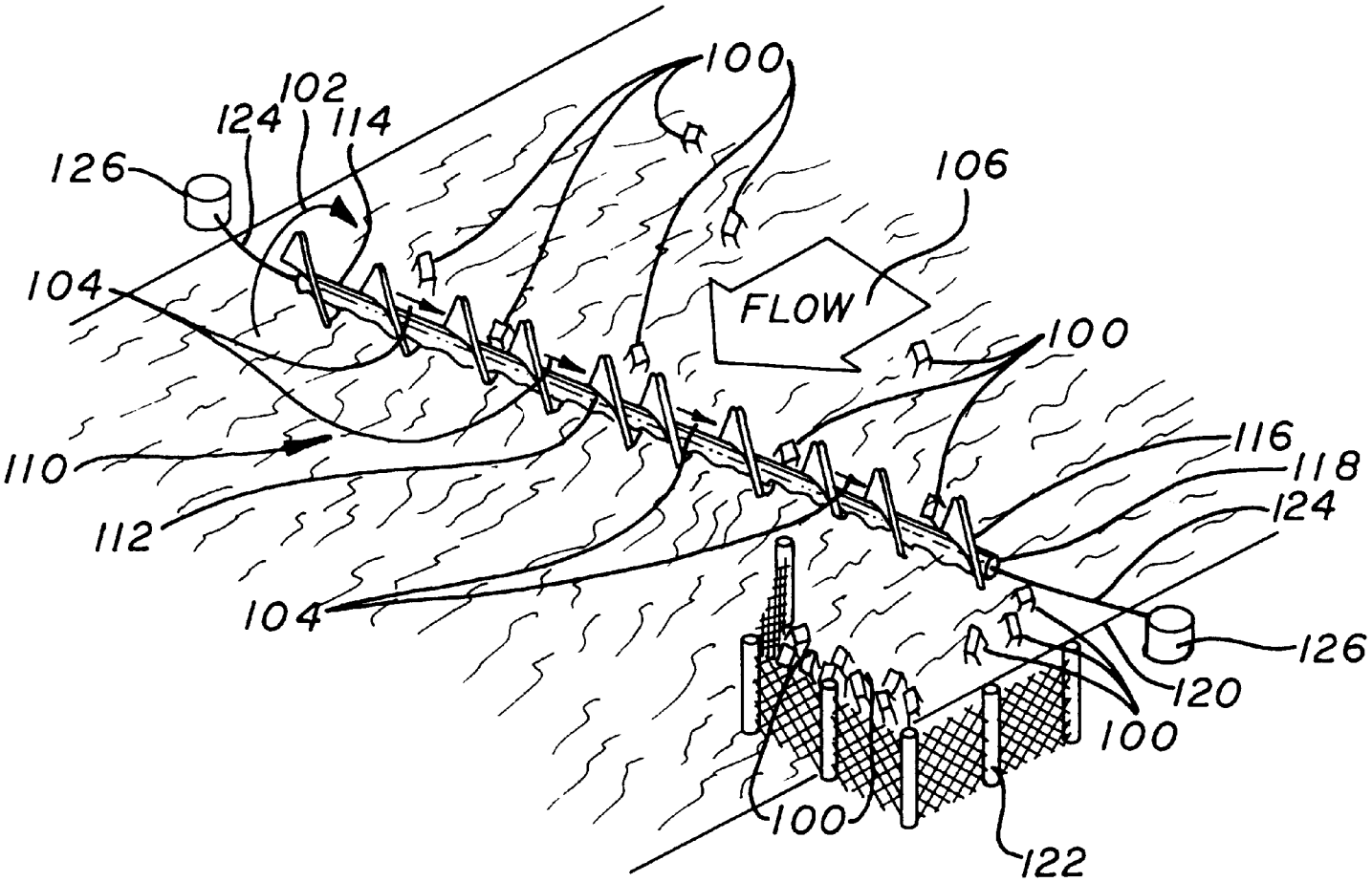
FIG. 1 is a perspective view of a helix boom installed in a waterway.
Figure 2:
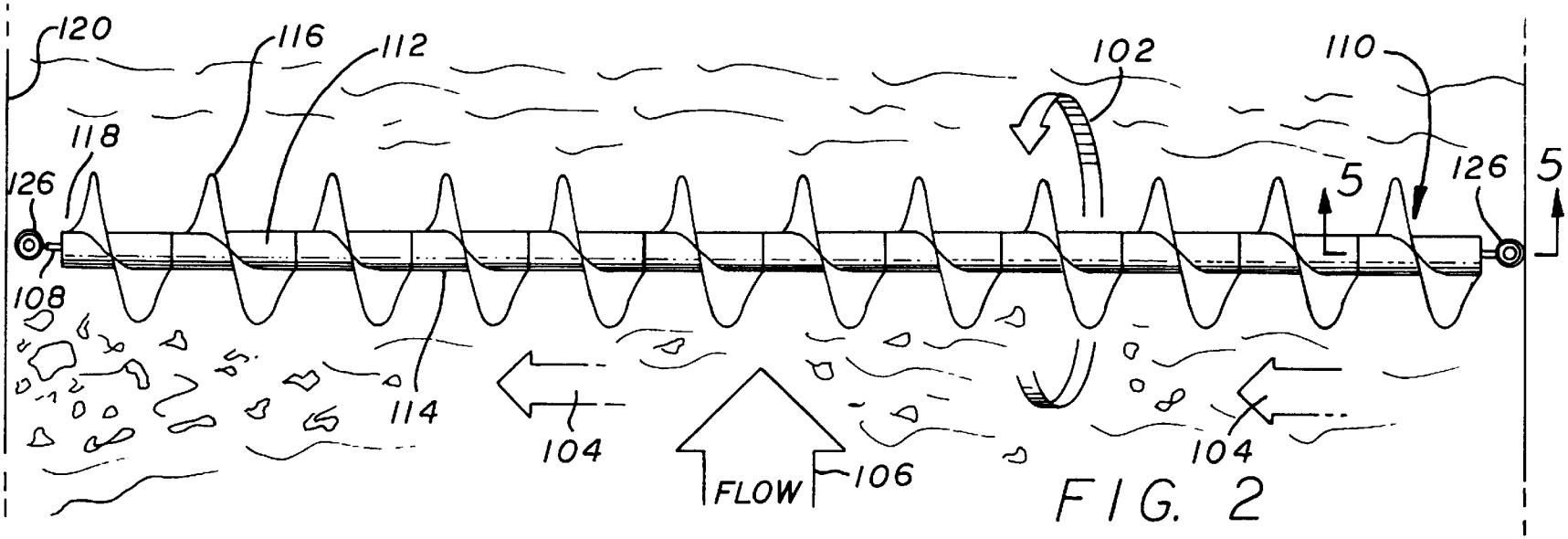
FIG. 2 is a plan view of an installed helix boom.

As shown in FIGS. 1 and 2, when floatables 100—Styrofoam cups, plastic containers, plastic bags, garden debris, leaves, small pieces of wood and other buoyant lightweight materials—encounter the helix boom 110 of the present invention, their ability to pass is impaired by the high profile of the boom's central structure 112. The buoyant nature of the boom 110 is such that it floats slightly above its center line. In so doing, the water will tend to flow 106 beneath the boom, depositing the floatables on the upstream surface 114 of the helix boom 110.

The water flowing below the helix boom 110 impacts the helix shaped fins 116 of the boom. The force of the flowing water on the helix boom 110 causes the boom to rotate. The lower, submerged portion of the boom rotates with the flow of water and the above water portion rotates against the flow as shown by the curved arrow 102 in FIG. 1. In one embodiment of the invention, a water flow of five miles per hour caused the boom 110 to rotate 102 at approximately ten revolutions per minute.

The helix boom 110 is comprised of three elements, the central structure 112, a fin 116 fixed to the central structure 112 to form a helix, and an axle 108 (FIG. 2) about which the central structure 112 and attached helical fin 116 may freely rotate. The boom 110 is buoyant with approximately one-half of the boom 110 submerged when in operation. The buoyancy of the boom 110 may be adjustable to accommodate differing densities of water, such as fresh water and salt water. The buoyancy is preferably adjusted such that slightly less than one-half of the central structure will be submerged when quiescently floating.

The boom 110 is attached to opposite sides of a waterway, in a manner that allows the helix boom 110 to float on the water's surface and rotate 102, driven by the flow 106 of water past the boom 110. In one embodiment, best seen in FIGS. 4–6, the boom 110 is attached 126 to the opposite sides of the waterway by a cable 124 that passes through a hollow axle 108. If the waterway empties, the connection to the sides of the waterway is such that the boom 110 can settle and rest on the bottom surface of the waterway. In a waterway with gently sloped sides, where the water level does not change greatly but the width of the water surface does increase significantly as the water level rises, attachment at fixed points on the sides of the waterway may suffice, as shown in FIG. 1. If the sides of the waterway are nearly vertical, an articulated attachment may be beneficially employed. FIG. 5 shows a slidable ring 528 on a vertical stanchion 526 that is useful for applications where the waterway has a nearly vertical side and significant changes in water level are encountered.

The helix 116 is in effect a continuous screw traversing the width of the waterway. The continuous nature of the helix 116 presents numerous three sided cells. Each cell is fronted by the upstream surface 114 of the central structure and is sided by two phases of the helical fin 116. Floatables 100 contained within the cells are moved across the face of the boom by the rotation of the helix boom 110 in the direction shown by the arrows 104 along the boom. The direction of motion of floatables 100 on the helix boom 110 is determined by the lead angle of the helix 116.

The rotation 102 of the boom 110 moves the floatables 100 from the point of interception to the end of the boom 118. As the floatables 100 reach the end of the boom 118 located near the side of the waterway 120, they leave the boom 110 at the side of the waterway 120. When the floatables 100 reach the side of the waterway 120, they may be contained and removed in a variety of ways.

As shown in FIG. 1, the floatables may be deposited in a collection bin 122 attached to the side of the waterway 120. The collection bin 122 contains the floatables 100 for removal by a vacuum truck, work crew, fork lift, etc. An exemplary collection bin 122 is comprised of three sides and a bottom. Sufficient current flow exists at the side of the waterway 120 to keep the removed floatables 100 contained within the collection bin 122. Collection bins 122 can be comprised of collapsing screen or mesh structures that are readily removed from the water. Once removed from the waterway, the floatable pollutants 100 are easily transferred to a truck. The bin 122 can be removed for cleaning with a crane, fork lift, work crew, etc.

The helix boom 110 may also be used to convey floatables 100 to a cyclonic separation device located at the side of the waterway. Separating ponds and weir type systems at the side of the waterway 120 are also suitable ways of containing and further concentrating the floatables 100 removed by the helix boom 110.

Figure 3:
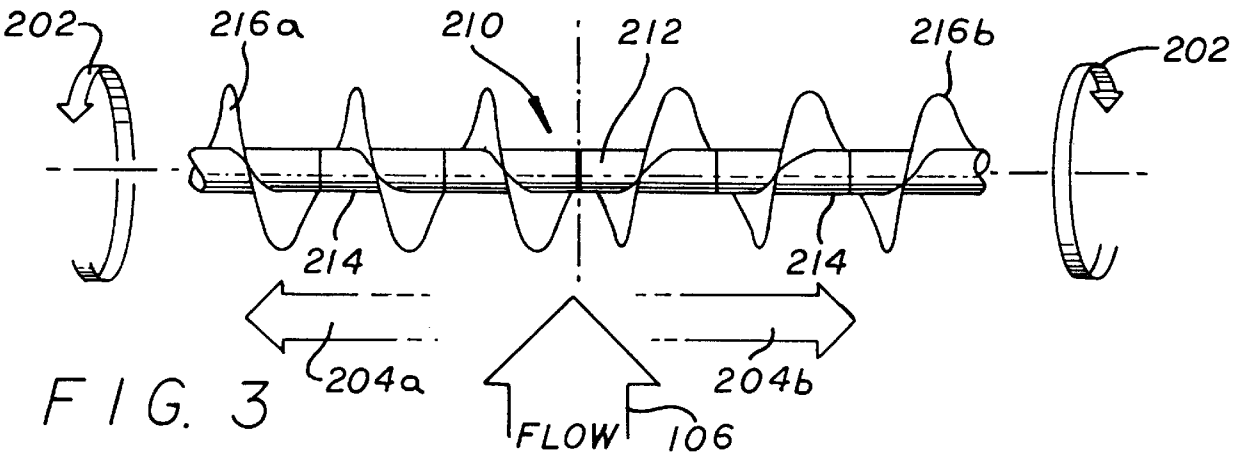
FIG. 3 is a plan view of another helix boom installed in a waterway.

In another embodiment shown in FIG. 3, the helix boom 210 is comprised of two helixes 216*a*, 216*b* of opposing handedness. This boom 210 will convey floatables from the middle portion of the boom toward both ends as shown by the two directional arrows 204*a*, 204*b*. This configuration may be desirable for very wide waterways and for waterways that yield more trapped floatables than can be contained by a single collection bin.

Figure 4:
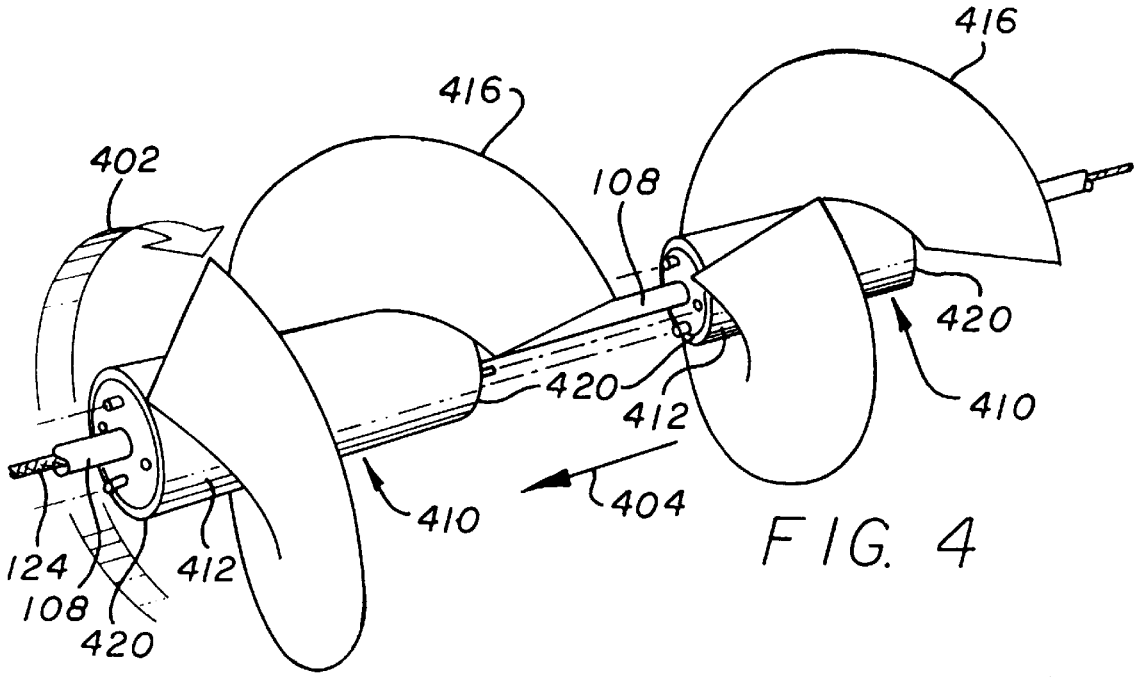
FIG. 4 is an exploded view of one portion of the helix boom shown in FIG. 2.
Figure 5:
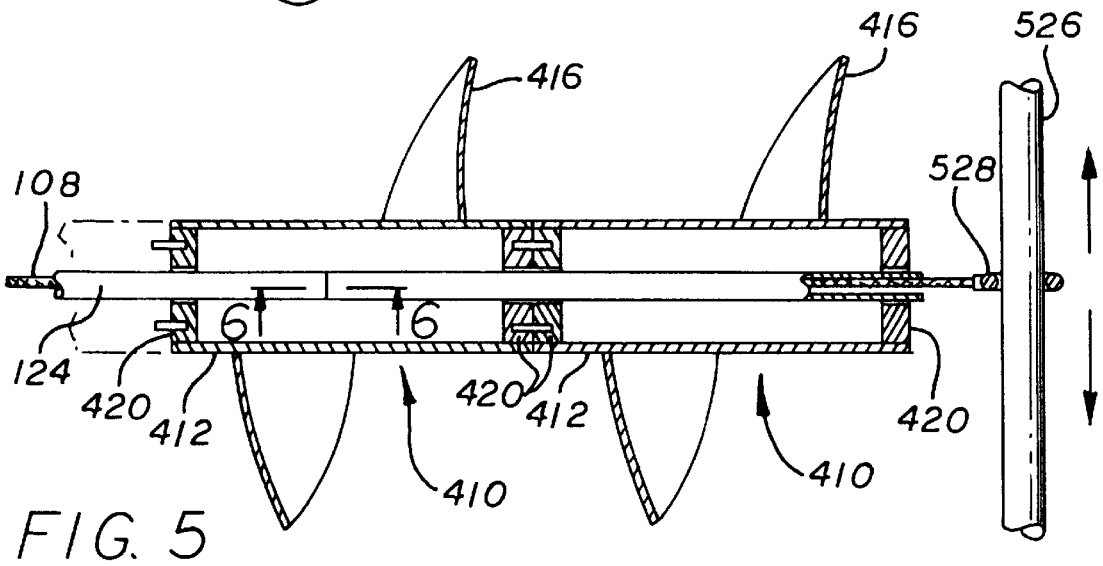
FIG. 5 is a sectional view of one portion of the helix boom shown in FIG. 2.

As may be seen in FIG. 2, the helix boom 110 may be comprised of individual segments, shown in FIG. 4, assembled at the waterway site. Each individual segment 410 is comprised of a center structure 412. Attached to the center structure 412 is a helical shaped fin 416 which provides both drive force 402 and floatable translation 404.

Figure 6:
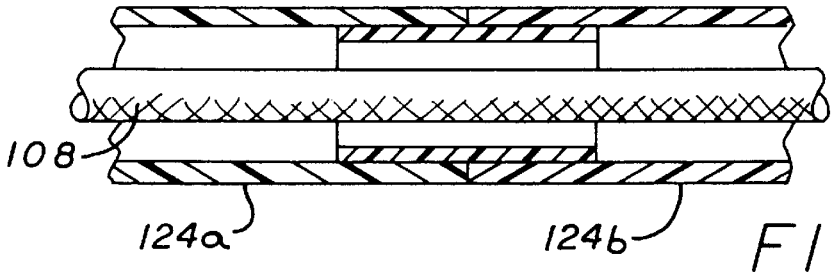
FIG. 6 is a detail of one portion of FIG. 5.

The boom's individual segments are assembled on a common shaft 124 or axle. The axle 124 may be comprised of a plurality of jointed pieces 124*a*, 124*b* as shown in FIGS. 5 and 6. In one embodiment, keyed joining members 420 are provided on each segment 410, allowing the segments 410 to be joined such that all the segments 410 will rotate together. As each helix segment 410 is self-sufficient, the boom 110 can be assembled to the optimum length for the location on the waterway.

Figure 7:
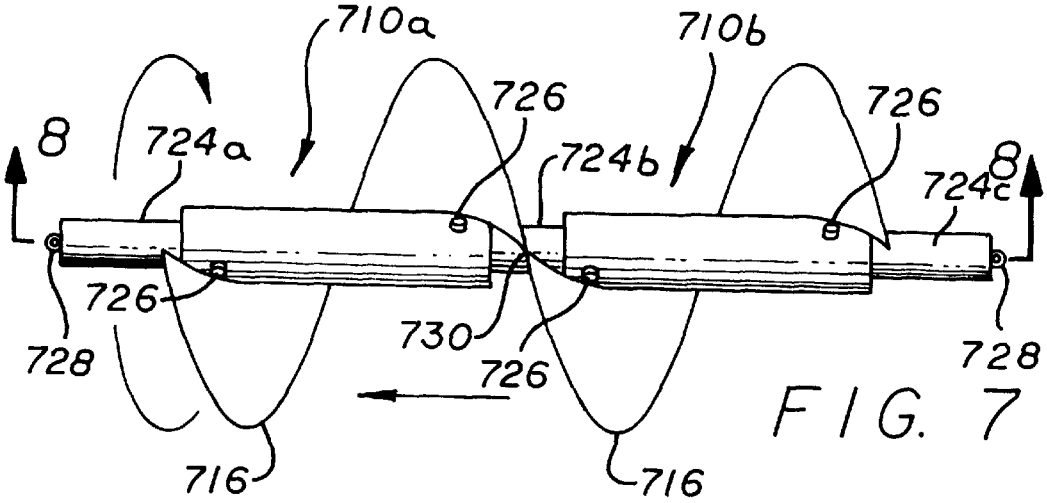
FIG. 7 is another embodiment of the invention.
Figure 8:
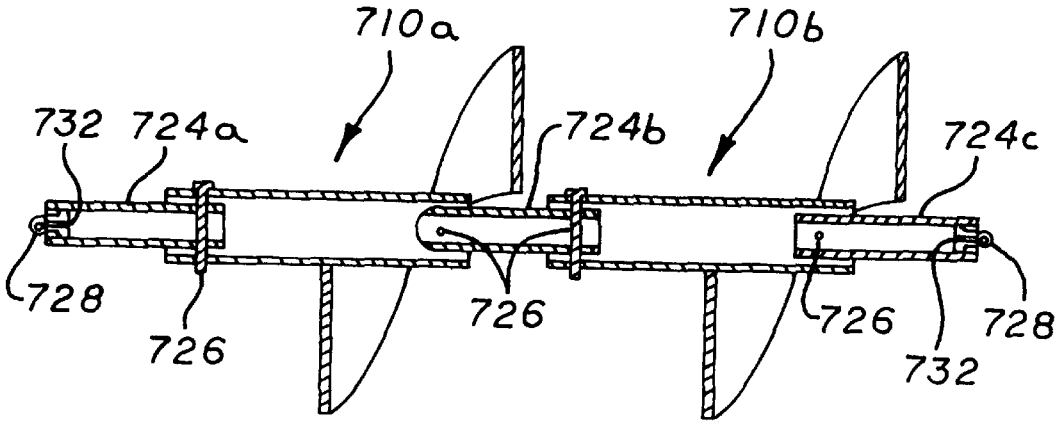
FIG. 8 is a sectional view of the embodiment shown in FIG. 7.

In another embodiment shown in FIGS. 7 and 8, the axle 724 is formed by a plurality of axle members 724*a*, 724*b*, 724*c* that are connected by pins 726 to the ends of adjacent boom segments 710*a*, 710*b*. The two pins in each axle member 724*b* are placed at right angles to create a flexible universal joint between the adjacent boom segments 710*a*, 710*b*. As may be seen in FIG. 8, the end axle members 724*a*, 724*c* provide a connecting device 728, such as a screw eye, that is rotatably mounted in the outer end of the end axle member 724*a*, 724*b*. The rotatable mounting may be by means such as a thrust bearing 732.

Figure 9:
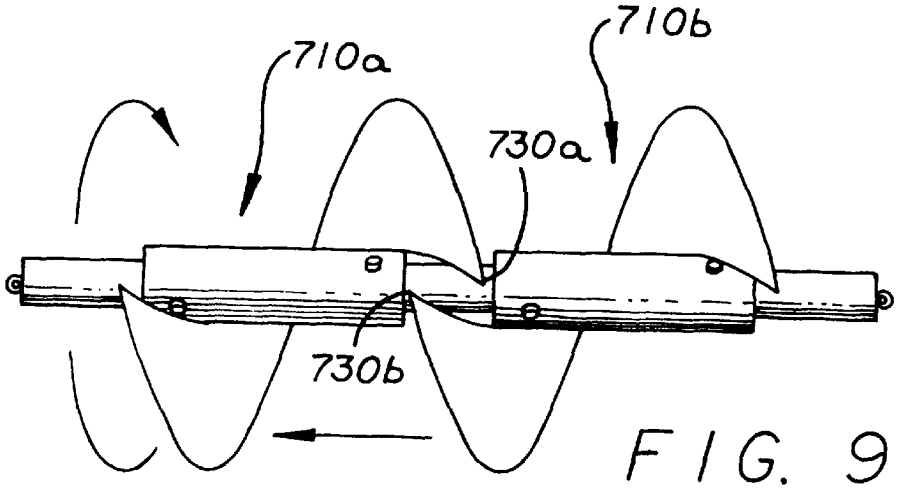
FIG. 9 is another embodiment of the invention.

As may be seen in FIG. 7, the leading and trailing edges 730 of the helical fins 716 of adjacent boom segments 710*a*, 710*b* are substantially coincident. It may be desirable to create a highly flexible helical boom structure where the close proximity of the leading and trailing edges 730 hinders the desired degree of flexibility. Another embodiment of the invention, shown in FIG. 9, displaces the leading edge 730*a* of one boom segment 710*a* from the trailing edge 730*b* of the adjacent boom segment 710*b*. In this configuration, floatables are discharged at the trailing edge 730*b* of the adjacent boom segment 710*b* and captured by the leading edge 730*a* of the first boom segment 710*a*.

Figure 10:
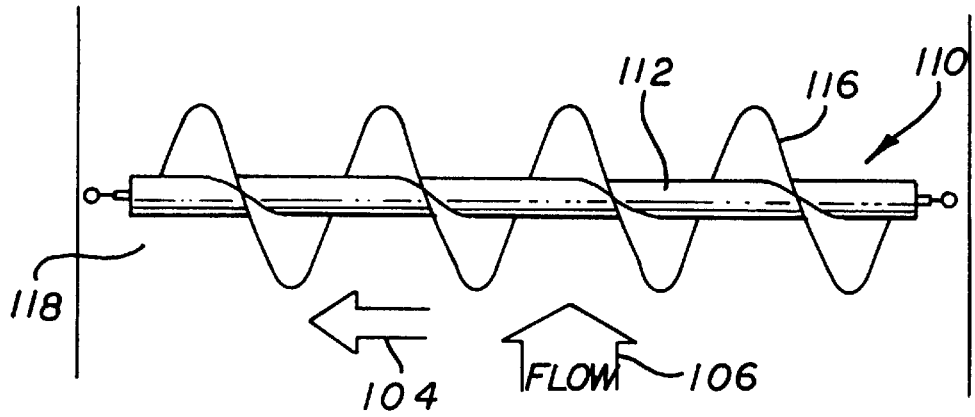
FIG. 10 is a plan view of one installed embodiment.
Figure 11:
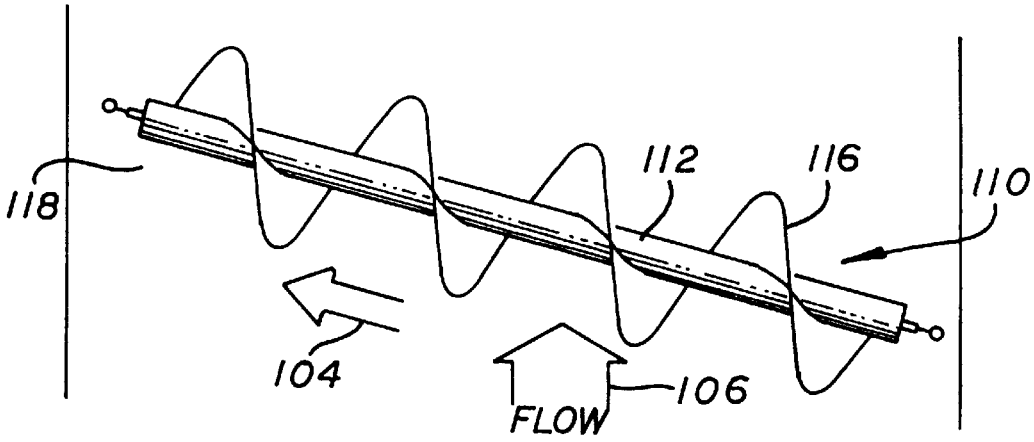
FIG. 11 is another installed embodiment.
Figure 12:
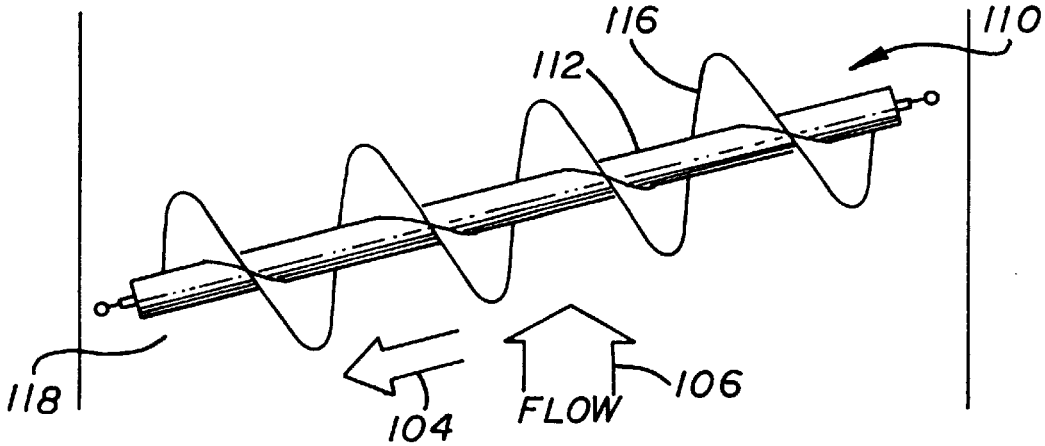
FIG. 12 is another installed embodiment.
Figure 13:
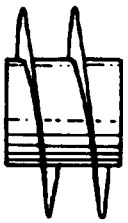
FIG. 13 illustrates one dimensional relationship.
Figure 14:
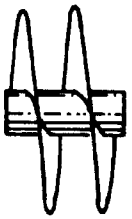
FIG. 14 illustrates another dimensional relationship.
Figure 15:
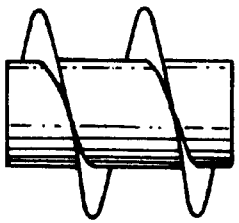
FIG. 15 illustrates another dimensional relationship.
Figure 16:
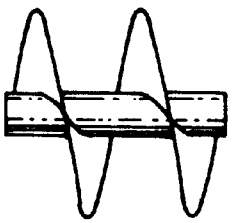
FIG. 16 illustrates another dimensional relationship.
Figure 17:
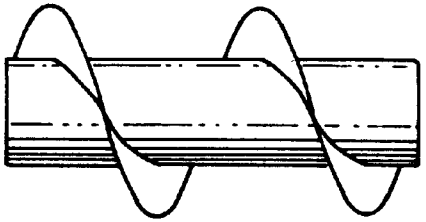
FIG. 17 illustrates another dimensional relationship.
Figure 18:
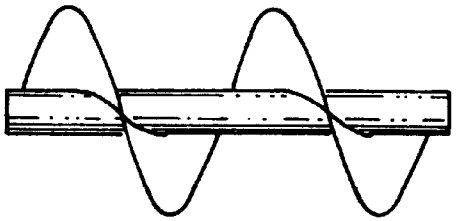
FIG. 18 illustrates another dimensional relationship.
Figure 19:
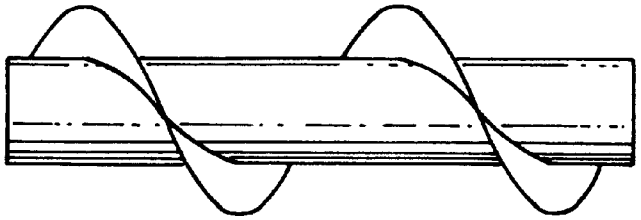
FIG. 19 illustrates another dimensional relationship.
Figure 20:
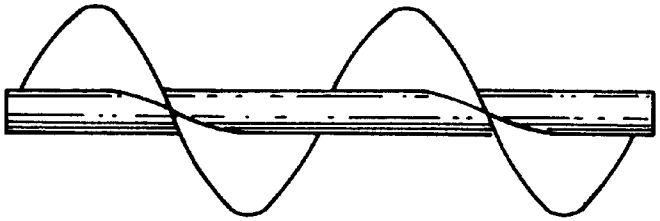
FIG. 20 illustrates another dimensional relationship.

The boom 110 may be placed substantially perpendicular to the flow 106 as shown in FIG. 10. However, it may be desirable to place the boom 110 at a slight angle, generally not to exceed the pitch angle of the helix 116. FIG. 11 shows an installation with the discharge end 118 displaced downstream as compared to the perpendicular installation. In this orientation, the submerged portion of the helix will present a higher angle of attack to the flow 104 of water and greater rotational forces will be developed. The translation flow 104 is assisted by the water flow 106. FIG. 12 shows an installation with the discharge end 118 displaced upstream as compared to the perpendicular installation. In this orientation, the submerged portion of the helix will present a lower angle of attack to the flow 104 of water and less force will be developed, reducing the tendency of the water flow to force the helix boom downstream. The above-water portion of the helix 116 will present a higher angle of attack to the floatables reducing the loss of floatables over the center portion 112 in some circumstances.

The fin 116 may be provided with various depths relative to the diameter of the center portion 112. Further, the helix 116 may be provided with various pitches relative to the overall diameter of the helix 116. Some possible relationships of these dimensions are illustrated in FIGS. 13–20. The dimensional relationships for these figures is given in Table 1.

TABLE 1

| FIG. | Diameter of Helix/ Diameter of Center | Pitch of Helix/ Diameter of Helix |
|---|---|---|
| 13 | 2 | 1/4 |
| 14 | 5 | 1/4 |
| 15 | 2 | 1/2 |
| 16 | 5 | 1/2 |
| 17 | 2 | 1 |
| 18 | 5 | 1 |
| 19 | 2 | 3/2 |
| 20 | 5 | 3/2 |

A low ratio of helix diameter to central structure diameter, resulting in a shallow fin depth, will increase the upstream face presented to the floatables, reducing washover. The shallow fin depth will reduce the rotational power produced by the water flow and reduce the coercive effect of the fin on the floatables. A high ratio of helix diameter to central structure diameter, conversely, increases rotational power and translation force at the expense of a lowered upstream face.

A low ratio of helix pitch to helix diameter provides more fin area which increase rotational force. However, a low pitch ratio reduces the space between fin faces and reduces the size of floatable that can be conveyed by the boom. A low pitch ratio also moves the floatables more slowly and reduces the capacity of the boom. A high pitch ratio increases the angle of attack which increases the rotational force for a given amount of fin area. The increased space between fin faces allows larger floatables to be conveyed at a higher translation speed but the coercive effect of the helix is reduced.

The dimension of the helix boom are preferably determined empirically. Factors such as expected maximum water velocity, floatable size distribution, and floatable loading should be considered.

While certain exemplary embodiments have been described and shown in the accompanying drawings, it is to be understood that such embodiments are merely illustrative of and not restrictive on the broad invention, and that this invention not be limited to the specific constructions and arrangements shown and described, since various other modifications may occur to those ordinarily skilled in the art. It will be appreciated that, while the invention has been described in its application to water flowing in natural or artificial waterways, the invention may be used to remove floating solids from any liquid flowing in a fluid channel.

What is claimed is:

1. A method for separating floating solid material from a fluid channel comprising:

providing a helix boom further comprising a plurality of boom segments with the plurality of boom segments substantially along a common longitudinal axis, each boom segment including a central segment along the longitudinal axis and a fin segment attached to the central segment along a helical path and substantially perpendicular to the longitudinal axis, and an axle with a first end and a second end, said axle located substantially along the common longitudinal axis such that the helix boom freely rotates about the axle;

anchoring the first end of the axle at a first side of the fluid channel;

anchoring the second end of the axle at a second side of the fluid channel, such that the helix boom will float with approximately one half of the central structure submerged when liquid flows in the fluid channel and the fin is rotated by a flow of liquid in the fluid channel;

whereby floating solid material will be conveyed to the first side of the fluid channel by the helix boom.

2. The method of claim 1, further comprising providing a debris containment system at the first side of the channel and downstream from the first end of the axle.

3. The method of claim 1, wherein the axle comprises a flexible cable.

4. The method of claim 1, wherein the diameter of the helix formed by the outer edge of the fin is between two and six times the diameter of the central structure.

5. The method of claim 1, wherein the pitch of the helical path of the fin is between one-fourth and three-halves times the diameter of the helix formed by the outer edge of the fin.

6. The method of claim 1, further comprising joining the plurality of boom segments such that all boom segments rotate substantially together.

7. The method of claim 6, wherein the plurality of boom segments are flexibly joined.

8. The method of claim 1, wherein each boom segment has a receiving end and a discharge end, the discharge end of a first boom segment overlaps the receiving end of a second boom segment, with the second boom segment closer to the first end of the helix boom than the first boom segment, whereby the first boom segment conveys floating debris from the discharge end of the first boom segment into the receiving end of the second boom segment.

9. The method of claim 1, wherein the second end of the axle is anchored substantially opposite the first end and substantially perpendicular to the direction of flow in the fluid channel.

10. A solid-liquid separation system comprising:

a helix boom further comprising, a plurality of boom segments with the plurality of boom segments substantially along a common longitudinal axis, each boom segment including a central segment along the longitudinal axis and a fin segment attached to the central segment along a helical path and substantially perpendicular to the longitudinal axis, and an axle with a first end and a second end, said axle located substantially along the common longitudinal axis such that the helix boom freely rotates about the axle;

a first anchor point at a first side of a fluid channel;

a second anchor point at a second side of the fluid channel;

a first connector joining the first end of the axle to the first anchor point;

a second connector joining the second end of the axle to the second anchor point;

wherein the helix boom will float with approximately one half of the central structure submerged when liquid flows in the fluid channel and be rotated by the flow of liquid in the fluid channel, whereby floating solid material will be conveyed to the first side of the fluid channel by the helix boom.

11. The system of claim 10, further comprising a debris containment system at the first side of the fluid channel and downstream from the first end of the axle.

12. The system of claim 10, wherein the axle comprises a flexible cable.

13. The system of claim 10, wherein the diameter of the helix formed by the outer edge of the fin is between two and six times the diameter of the central structure.

14. The system of claim 10, wherein the pitch of the helical path of the fin is between one-fourth and three-halves times the diameter of the helix formed by the outer edge of the fin.

15. The system of claim 10, wherein the plurality of boom segments are joined such that all boom segments rotate substantially together.

16. The system of claim 15, wherein the plurality of boom segments are flexibly joined.

17. The system of claim 10, wherein each boom segment has a receiving end and a discharge ends the discharge end of a first boom segment overlaps the receiving end of a second boom segment, with the second boom segment closer to the first end of the helix boom than the first boom segment, whereby the first boom segment conveys floating debris from the discharge end of the first boom segment into the receiving end of the second boom segment.

18. The system of claim 10, wherein the second end of the axle is anchored substantially opposite the first end and substantially perpendicular to the direction of flow in the fluid channel.

19. A solid-liquid separation system comprising:

a buoyant helix boom that will float in liquid, the buoyant helix boom further comprising, a central structure having a longitudinal axis, a fin attached to the central structure along a helical path and substantially perpendicular to the longitudinal axis, and a non-rotating axle with a first end and a second end, said non-rotating axle located substantially along the longitudinal axis such that the buoyant helix boom freely rotates about the non-rotating axle;

a first anchor point at a first side of a fluid channel;

a second anchor point at a second side of the fluid channel;

a first connector joining the first end of the axle to the first anchor point;

a second connector joining the second end of the axle to the second anchor point;

wherein the buoyant helix boom will float with approximately one half of the central structure submerged when liquid flows in the fluid channel and be rotated only by the flow of liquid in the fluid channel substantially perpendicular to the longitudinal axis, whereby floating solid material will be conveyed to the first side of the fluid channel by the buoyant helix boom.

20. The system of claim 19, further comprising a debris containment system at the first side of the fluid channel and downstream from the first end of the non-rotating axle.

21. The system of claim 19, wherein the non-rotating axle comprises a flexible cable.

22. The system of claim 19, wherein the diameter of the helix formed by the outer edge of the fin is between two and six times the diameter of the central structure.

23. The system of claim 19, wherein the pitch of the helical path of the fin is between one-fourth and three-halves times the diameter of the helix formed by the outer edge of the fin.

24. The system of claim 19, wherein the buoyant helix boom further comprises a plurality of boom segments, each boom segment comprised of a central segment and a fin segment attached to the central segment along a helical path, each boom segment having a receiving end and a discharge end, with the plurality of boom segments substantially along a common longitudinal axis.

25. The system of claim 24, wherein the plurality of boom segments are joined such that all boom segments rotate substantially together.

26. The system of claim 25, wherein the plurality of boom segments are flexibly joined.

27. The system of claim 24, wherein the discharge end of a first boom segment overlaps the receiving end of a second boom segment, with the second boom segment closer to the first end of the helix boom than the first boom segment, whereby the first boom segment conveys floating debris from the discharge end of the first boom segment into the receiving end of the second boom segment.

28. The system of claim 19, wherein the second end of the non-rotating axle is anchored substantially opposite the first end and substantially perpendicular to the direction of flow in the fluid channel.

* * * * *